US008133087B1

(12) United States Patent
Abou Zeid et al.

(10) Patent No.: US 8,133,087 B1
(45) Date of Patent: Mar. 13, 2012

(54) COOLING WATER DISTRIBUTION SYSTEM WITH DEBRIS EVACUATION CAPABILITY

(75) Inventors: Amir Abou Zeid, Waupun, WI (US); Charles H. Eichinger, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 291 days.

(21) Appl. No.: 12/701,980

(22) Filed: Feb. 8, 2010

(51) Int. Cl.

| | |
|---|---|
| ***B63H 21/14*** | (2006.01) |
| ***F01P 3/20*** | (2006.01) |
| ***F02B 61/04*** | (2006.01) |
| *B63H 21/10* | (2006.01) |
| *B63H 21/38* | (2006.01) |
| *B63H 20/00* | (2006.01) |
| *F02B 75/20* | (2006.01) |

(52) U.S. Cl. ..... 440/88 C; 440/88 R; 440/88 L

(58) Field of Classification Search ..... 440/88 R, 440/88 C, 88 N, 88 D, 88 G, 88 J, 88 K, 88 L, 440/88 HE See application file for complete search history.

(56) References Cited

U.S. PATENT DOCUMENTS

| | | | | |
|---|---|---|---|---|
| 4,776,820 | A | 10/1988 | Mapes | |
| 5,462,464 | A * | 10/1995 | Ming | 440/88 L |
| 5,579,727 | A | 12/1996 | Logan et al. | |
| 5,664,526 | A | 9/1997 | Logan et al. | |
| 6,004,175 | A | 12/1999 | McCoy | |
| 6,033,272 | A | 3/2000 | Whiteside | |
| 6,506,085 | B1 | 1/2003 | Casey et al. | |
| 6,699,086 | B1 * | 3/2004 | Belter et al. | 440/88 C |
| 7,005,077 | B1 | 2/2006 | Brenner et al. | |
| 7,108,782 | B1 | 9/2006 | Higgins et al. | |
| 7,128,027 | B1 | 10/2006 | Straub et al. | |
| 7,513,812 | B1 * | 4/2009 | Hochmayr et al. | 440/111 |

* cited by examiner

*Primary Examiner* — Lars A Olson
*Assistant Examiner* — Anthony Wiest
(74) *Attorney, Agent, or Firm* — William D. Lanyi

(57) ABSTRACT

An outboard motor cooling water distribution system directs water from the water jacket of an engine through a container in which a conduit has a first inlet opening that is configured to cause a water stream to entrain debris from a region near a drain opening of the container and prevent the debris from building up in the vicinity of the drain opening. Debris which is heavier than the water is drawn upwardly through the first inlet opening of the conduit and conducted away from the container. Debris which is lighter than water is entrained in a second water flow and conducted through a second inlet opening of the conduit so that it can be drawn into the conduit and conducted away from the container. The creation of the first water flow maintains the area around the drain opening in a clean condition as a result of the velocity and direction of the water flow caused by the position and size of the first inlet opening of the conduit. The primary function of the present invention is to prevent a buildup of debris in the area around the drain opening and the potential blockage of the drain opening that could result from that type of buildup.

7 Claims, 8 Drawing Sheets

COOLING WATER DISTRIBUTION SYSTEM WITH DEBRIS EVACUATION CAPABILITY

BACKGROUND OF THE INVENTION

1. Field of the Invention

The present invention is generally related to a cooling water distribution system for a marine propulsion device and, more particularly, to a water system that is configured to remove debris from the vicinity of a drain opening and, in some circumstances, from the region proximate the surface of water stored in a container of the water system.

2. Description of the Related Art

Those skilled in the art of marine propulsion system are familiar with many different configurations in which water is conducted through an internal combustion engine and through one or more containers that temporarily retain the water in thermal communication with other components of the marine propulsion system before directing the water back to a body of water from which it was originally drawn. In many cases, the water is temporarily held in a container within the driveshaft housing of the marine propulsion device, such as an outboard motor, as it is directed downwardly through the driveshaft housing and back to the body of water.

U.S. Pat. No. 4,776,820, which issued to Mapes on Oct. 11, 1988, discloses a bilge water pump mechanism for an outboard motor cowl. It describes a pump mechanism continuously operable by the engine of an outboard motor for discharging water that collects by seepage or leakage into the engine cowl. The pump mechanism includes an inlet conduit having an inlet end positioned closely adjacent to the bottom of an inclined channel formed in the lower section of the engine cowl and an outlet conduit having an outlet end positioned exteriorly of the cowl. A filter disposed in the inlet conduit removes debris from the water and protects the pump mechanism and the bracket mounted to the engine block holds the inlet end of the inlet conduit closely adjacent to the bottom of the channel.

U.S. Pat. No. 5,579,727, which issued to Logan et al. on Dec. 3, 1996, discloses a separating apparatus for the cooling system of a marine engine. It describes an apparatus for separating solid material from cooling water in the cooling system of a marine engine. The apparatus includes a hollow member or housing having an inlet to receive cooling water and having an outlet. A drain opening is located in the housing above the bottom surface of the housing and is connected through a suitable conduit to a temperature responsive drain valve. A generally J-shaped tubular member is disposed in the housing and has one end connected to the drain outlet while a second end is slightly above the bottom surface of the housing out of alignment with the inlet. When the drain valve is open, water will drain through the housing to the drain outlet while solid debris will collect in the bottom of the housing beneath the second end of the tubular member.

U.S. Pat. No. 5,664,526, which issued to Logan et al. on Sep. 9, 1997, discloses an apparatus for separating solid material from cooling block water in a marine engine block. An apparatus for separating solid material from cooling water in the cooling system of the engine block of a marine engine is described. The engine block comprises a plurality of cylinder bores surrounded by a cooling passage through which cooling water is pumped. The bottom portion of the block includes a drain outlet that communicates with the cooling passage and a tubular separating member that has a first generally horizontal section that is sealed within the drain outlet. The tubular separator also includes a second section that is located within the cooling passage and extends downwardly from the inner end of the first section and is located between two adjacent cylinder bores. The lower end of the second section is closed and a port is provided in the side of the second section adjacent the closed end and facing toward one of the cylinder bores. The outer end of the first section of the tubular member, which is located on the exterior of the block, is connected through a suitable hose or conduit to an automatic drain valve which is located at a level beneath the engine block. When the ambient temperature falls beneath a selected value, the drain valve will open and water will drain from the engine block through the tubular separator to the drain valve, while solid debris will collect in the bottom of the cooling passage beneath the level of the port to prevent the debris from contacting the temperature responsive valve.

U.S. Pat. No. 6,004,175, which issued to McCoy on Dec. 21, 1999, discloses a flush valve which uses only one moving component. A ball is used to seal either a first or second inlet when the other inlet is used to cause water to flow through the valve. The valve allows freshwater to be introduced into a second inlet in order to remove residue and debris from the cooling system of the marine propulsion engine. When freshwater is introduced into a second inlet, the ball seals the first inlet and causes the freshwater to flow through the engine cooling system. When in normal use, water flow through the first inlet and seals the second inlet by causing the ball to move against a ball seal at the second inlet. Optionally, a stationary sealing device can be provided within the second inlet and a bypass channel can be provided to allow water to flow pass the ball when the ball is moved against the ball seat at the first inlet. This minimal flow of water is provided to allow lubrication for the sea water pump impeller if the sea water pump is operated during the flushing operation in contradiction to recommended procedure.

U.S. Pat. No. 6,033,272, which issued to Whiteside on Mar. 7, 2000, describes a marine jet drive system with a debris cleanout feature. A marine jet propulsion system for a boat or the like comprises a power plant for rotating a driveshaft. A gear system is connected to the driveshaft and is configured to engage and rotate an impeller shaft. A clutch system is provided for selectively causing the impeller shaft to alternatively be engaged by one or the other of ring gears and thereby selectively rotating the impeller in opposite directions. By this arrangement, rotation of the impeller in a first direction draws water through the housing in normal fashion to provide thrust at the exit opening while rotation of the impeller in the opposite direction reverses the flow through the housing and causes debris to be flushed out of the impeller or inlet opening.

U.S. Pat. No. 6,506,085, which issued to Casey et al. on Jan. 14, 2003, discloses a pump and drain apparatus for a marine propulsion system. An integral pump and drain apparatus is contained in a common housing structure to reduce the required space needed for these components in the vicinity proximate the engine of a marine propulsion system. The valve of the drain is remotely actuated by air pressure and therefore does not require the boat operator to manually remove plugs or manually actuate mechanical components to cause the engine to drain through a drain conduit that is formed as an integral part of the housing structure.

U.S. Pat. No. 7,005,077, which issued to Brenner et al. on Feb. 26, 2006, describes a shipboard human waste treatment for removing solids. A method and system for separating human waste solids from liquid for a shipboard toilet system that allows for the separation of solid waste, compaction of the solid waste and storage of solid waste is described. Wastes are deposited into a shipboard toilet system that uses vacuum toilets to flush waste into a large inclined solid waste separating tank. A vacuum pump is attached to the separation tank to maintain negative pressure within the tank and system to move the separated liquid stream. The separation tank has a separating screen disposed across its entire width to retain solid wastes while allowing liquid to flow through. After separation from liquids, solid waste material is compacted and dewatered with a helical screw through an inclined tube, and packaged for later removal as landfill or burned in the ship incinerator.

U.S. Pat. No. 7,108,782, which issued to Higgins et al. on Sep. 19, 2006, describes a marine vessel on board wastewater treatment system. Shipboard wastewater undergoes treatment within an automatic system based on membrane bioreactor technology. Using selective control established through an operator interface, the system can be operated under automatic process/standby mode or maintenance mode and sludge concentrate can be directed either overboard, to an onboard storage tank or to undergo further treatment within an concentration device or destruction within an incinerator for example depending on the ship's equipment, location and operating conditions.

U.S. Pat. No. 7,128,027, which issued to Straub et al. on Oct. 31, 2006, discloses a cooling system for an outboard motor. A cooling system of an outboard motor provides back and forth flow of water from one side of an exhaust passage to the opposite side in order to avoid the creation of stagnant pools of water within which minerals and debris can collect. This result is accomplished by causing the cooling water to flow back and forth from one side of the exhaust passage to the other so that all portions of the water passages are forced to conduct water through them at a relatively high velocity. A water reservoir is formed between an exhaust conduit and an oil reservoir in order to reduce the operating temperature of the oil within the reservoir.

The patents described above are hereby expressly incorporated by reference in the description of the present invention.

Although some outboard motors utilize filtering devices and related techniques to avoid the intake of debris through the cooling system of its engine, some types of debris can bypass them and be conducted through the cooling system. As these materials, such as soil and sand, pass through the engine cooling system, they can collect in the lower regions of some of the containment portions of the cooling system. As the debris accumulates in the lower portions of various containers, some drain openings can possibly be blocked. Usually the drain openings that become blocked in this way are intended to function in a manner that allows water to drain out of the system in order to avoid damage that can be caused when accumulated water freezes. These situations are particularly troublesome because the engine can appear to be operating normally even though the small drain openings are completely blocked. Water can be drawn into the cooling system, directed through the engine water jacket, conducted into a temporary reservoir which allows other components to be cooled by the water, and through a pickup conduit that then directs the water back to the body of water. These operations can be performed in a way that appears normal even though a drain opening in the temporary holding container is completely blocked. The problem may only appear at some later time when the accumulated water within that temporary holding container is subjected to freezing temperatures. Those freezing temperatures can create ice within the cooling system and the expansion of the ice can create severe damage. It would therefore be significantly beneficial if the normal operation of the marine propulsion device could remove debris from the region of the drain openings so that the ice is not formed at a later time. It would be particularly beneficial if the normal operation of the outboard motor could keep the region clean in the area surrounding the drain opening without any additional effort required by the operator. It would also be significantly beneficial if the system could allow an easy cleanout procedure so that debris can be removed from regions that are not close to the drain openings, but are in other portions of the bottom regions of the reservoir.

SUMMARY OF THE INVENTION

An outboard motor cooling water distribution system, according to preferred embodiments of the present invention, comprises an internal combustion engine, a vertical crankshaft supported by the internal combustion engine for rotation about a generally vertical axis, and a water circulation system disposed in thermal communication with a heat emitting component of the internal combustion engine, the water circulation system being configured to receive water from a body of water in which the outboard motor cooling water distribution system is operating. The preferred embodiments of the present invention further comprise a container configured to receive water from the water circulation system, a drain opening formed through a bottom surface of the container and configured to conduct a portion of the water out of the container, and a conduit having a first inlet opening and a first outlet opening. As will be described in greater detail below, certain embodiments of the present invention further comprise a second inlet opening.

The first inlet opening is spaced apart from the drain opening and disposed at a first location which induces a first water flow which causes a first group of debris to move relative to the drain opening and become entrained within the first water flow. The conduit is configured to direct a majority of the first water flow and at least some of the first group of debris though the first outlet opening and away from the container. The conduit can have the second inlet opening disposed at a second location which induces a second water flow which causes a second group of debris to become entrained within the second water flow. The first outlet opening of the conduit is disposed at a third location. The conduit is configured to direct a majority of the second water flow and at least some of the second group of debris through the outlet opening and away from the container. The heat emitting component of the internal combustion engine, in a preferred embodiment of the present invention, can be an oil sump which is disposed in fluid communication with oil conduits of the internal combustion engine. The oil sump is disposed in thermal communication with the water within the container.

In certain embodiments of the present invention, a portion of the conduit, between the first and second inlet openings, is disposed within the container. In alternative embodiments of the present invention, that portion of the conduit between the first and second inlet openings is disposed outside the container. In preferred embodiments of the present invention, the conduit is configured to direct all of the first and second water flows through the first outlet opening. In most embodiments of the present invention, a majority of the first group of debris is denser than the water within the container and is also denser than the second group of debris. The second inlet opening is configured to control a depth of the water within the container as a function of a position of the second inlet opening relative to the bottom surface of the container.

In certain embodiments of the present invention, it further comprises a cooling water input conduit of the water circulation system which is connected in fluid communication between the container and the engine to direct cooling water from a water jacket of the engine to an internal cavity of the container. The heat emitting component is disposed in thermal communication with the water within the internal cavity.

In most embodiments of the present invention, all fluid communication with the container is through the first and second inlet openings, the water circulation system, and the drain opening.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
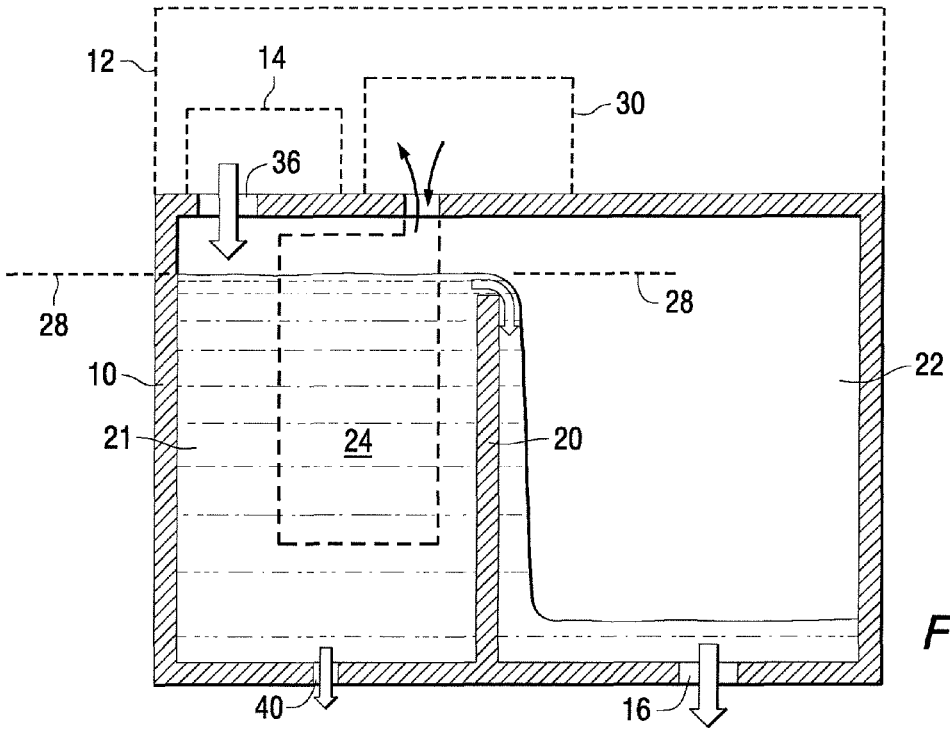
FIGS. 1 and 2 show two known configurations of a water container that receives water from an engine cooling system and directs the water back to a body of water from which it was drawn.

Throughout the description of the preferred embodiment of the present invention, like components will be identified by like reference numerals.

FIG. 1 is a schematic representation of a container 10 that is configured to temporarily retain a quantity of water as it flows from an engine 12. In a typical outboard water circulation system, the water is circulated through a water jacket that causes the cooling water to flow in thermal communication with heat emitting components of the engine 12. The water jacket 14 then discharges the water into a first cavity 21 of the container 10 which holds the water temporarily before discharging it, through a discharge opening 16, back to the body of water in which the outboard motor is operated. FIG. 1 is intended to be a simplified functional illustration showing how that water is handled during its temporary containment after discharge from the engine 12 and before its flow through discharge opening 16 back to the body of water. A wall 20 within the container 10 divides the internal space of the container into a first cavity 21 and a second cavity 22. In a typical arrangement, the heat emitting component 24 is disposed within the first cavity 21 so that it can be cooled by the water in the first cavity. During normal operation of the outboard motor, the height of the water in the first cavity 21 is regulated by the height of the wall 20. Dashed line 28 illustrates the height of the water in the first cavity 21 that is used to cool the heat emitting component 24 which, in a typical application, is an oil sump. The oil sump contains oil that is circulated through regions of the engine 12 which are represented by dashed line box 30. This oil flows back and forth between lubricated regions 30 and the oil sump 24 and heat is removed from the oil within the oil sump as it passes into and out of the first cavity 21. After flowing over the wall 20, the water flows out of the second cavity 22 through the discharge opening 16 and returns to the body of water in which the outboard motor is operated. In normal operation, the significant majority of the water flowing through the engine 12 flows into the container through the inlet conduit 36 and out of the container 10 through discharge opening 16. Another opening 40 is shown in the first cavity 21. That opening is a drain opening 40 which serves a very important purpose by allowing water to flow out of the container 10 after the outboard motor is no longer being operated. If the drain opening 40 did not exist, or became inoperative, water could be retained within the container 10 and cause various severe problems. One problem is that reduced temperatures, when the outboard motor is not being used, can cause retained water to freeze within the container 10 and result in serious damage. This problem will be described in greater detail below.

Another problem that can be caused if the drain opening 40 is blocked is the eventual retention of a sufficient amount of debris within the first cavity 21 to adversely affect the removal of heat from the component 24. This could be caused by the insulating effect of the debris which can eventually cover a significant portion of the surface of the component 24. Even though water can exit from the container 10 through the other outlet 16, the outboard motor could continue to retain water and debris within the first cavity 21. It should be understood that the illustration in FIG. 1 is highly schematic and intended to show the various functions of the components of the water circulation system.

Figure 2:
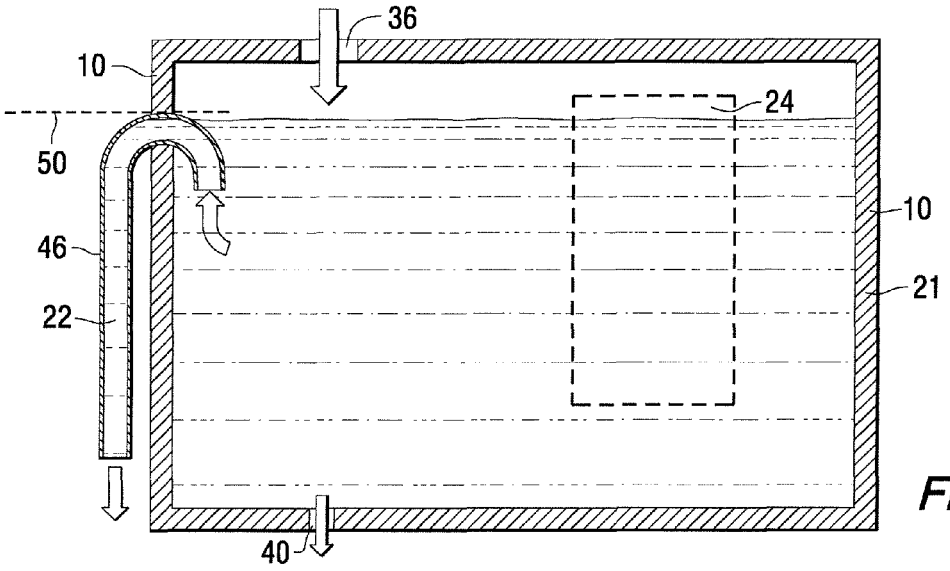

FIG. 2 illustrates a slightly different configuration of the water circulation system. For purposes of simplicity, the outboard motor 12, the water jacket 14, and the oil circulation system 30, which are schematically represented in FIG. 1, are not shown in FIG. 2. However, it should be understood that the container and other components which are illustrated in FIG. 2 are associated with those components even though they are absent from FIG. 2. In the functional terminology described above, the first cavity 21 would comprise virtually the entire space within the container 10 in FIG. 2 and the secondary cavity 22 would be the space within the conduit 46. During operation, water would flow from the engine cooling circuit, through opening 36, and into the first cavity 21 of the container 10. After filling cavity 21 to the height generally represented by dashed line 50, water would flow out of the first cavity, through the conduit 46, and away from the container 10. The heat emitting component 24, such as an oil sump, is again represented by a dashed line box to illustrate the fact that in most applications the heat emitting component is disposed in thermal communication with the water within the container 10.

FIGS. 1 and 2 are provided for the purpose of showing that various alternative arrangements can be provided to make use of the water for the purpose of cooling various components as it flows from the engine 12 back to the body of water in which the outboard motor is used. The specific arrangement of walls 20 or conduits 46 can vary from one application to another, but the basic situation remains the same. An inlet port 36 and an outlet port 16 (or outlet of conduit 46) conduct water through the container 10, which is normally disposed within the driveshaft housing of the outboard motor, and the water is temporarily contained within the container 10 for the purpose of cooling the various heat emitting components 24 such as oil sumps and other components. The schematic representations of FIGS. 1 and 2 are provided for the purpose of showing how a potentially significant problem can arise through the accumulation of debris. It should be noted, with reference to FIGS. 1 and 2, that the opening 16 is significantly greater than drain opening 40. The intended function of discharge opening 16 is to allow the total flow of water that is used to cool the engine 12 to exit through opening 16 and return back to the body of water. On the other hand, the drain opening 40 is intended to allow any retained water within the cavities to flow out of the container during the subsequent period of time when the outboard motor is no longer being operated. The drain opening 40 is therefore intended to allow a slow, but reliable, removal of this water in order to avoid the retention that could result in frozen water that could cause the damage described above. This disparity in size and flow capability between discharge openings 16 (or conduit 46) and the much smaller drain opening 40 can also result in the misleading condition in which the outboard motor appears to be operating satisfactorily, with all of the water that flows through the engine 12 being emitted through opening 16 during the normal operation of the outboard motor. It is easy to overlook the fact that, when the outboard motor is not being operated, no water is flowing through the drain opening 40. As a result, water can be retained within the first cavity 21 of the container 10 and this can possibly result in damage at a later time when lower temperatures occur.

Figure 3:
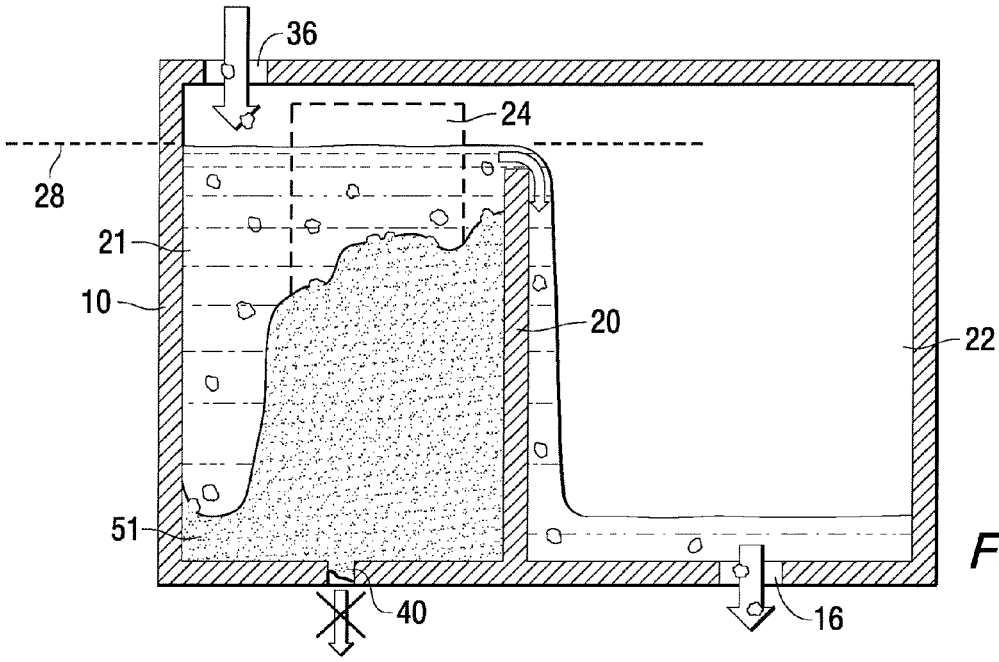
FIGS. 3 and 4 are generally similar to FIGS. 1 and 2, but with debris collected in the bottom portions of the water container in a manner which blocks the drain opening.

In FIG. 3, a significant quantity of a first debris 51 is shown in a position where it has collected in the bottom portion of the first cavity 21 to a sufficient degree to completely block the drain opening 40. As can be seen by the continued flow of water over the wall 20, which maintains the water level 28 and the continued flow of water out of discharge outlet 16, the blockage of the much smaller drain opening 40 is not readily obvious. The buildup of the first group of debris 51 may eventually decrease the cooling efficiency of the first cavity 21, but that is not likely to happen quickly and the potential damage caused by freezing of retained water within the first cavity 21 is probably more likely.

Figure 4:
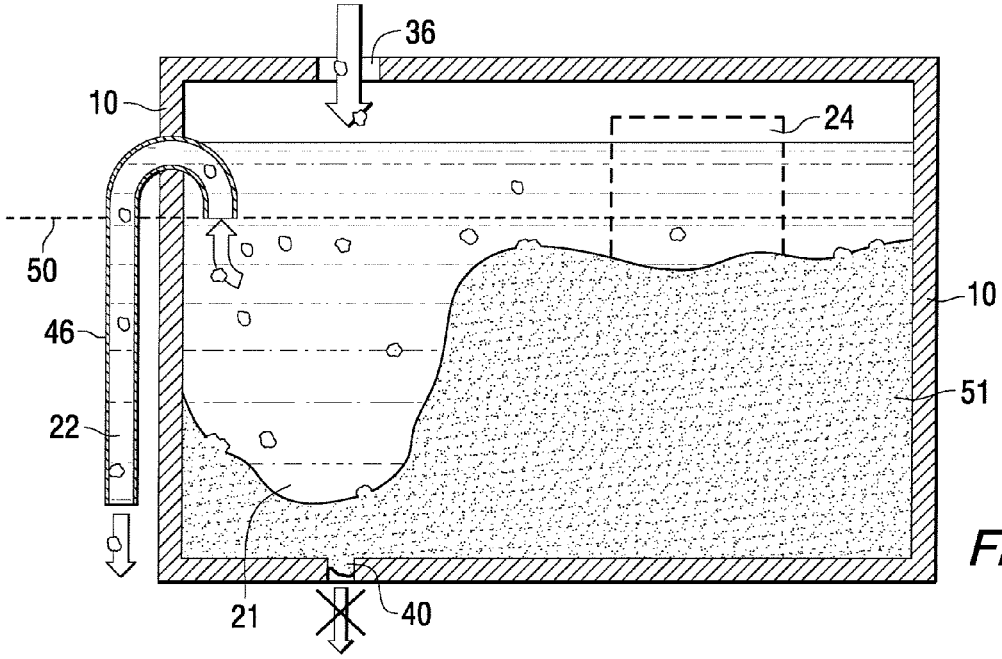

FIG. 4 illustrates a system similar to FIG. 2, but after the accumulation of the retained first group of debris 51 due to the blockage of the drain opening 40. Once again, the normal flow of water through an inlet opening 36, through the conduit 46, and through the second cavity 22 would continue even though the smaller drain opening 40 is completely blocked by the accumulation of the first group of debris 51 within the first cavity 21. Once again, the heat emitting component 24 is likely to be normally cooled until the first group of debris 51 accumulates to a significant amount within the container 10. However, as in the example shown in FIG. 3, the blockage of the drain opening 40 will result in the retention of water to the level represented by dashed line 50 and, if temperatures are reduced, can result in the damage that would normally be caused by freezing water within a containment.

Figure 5:
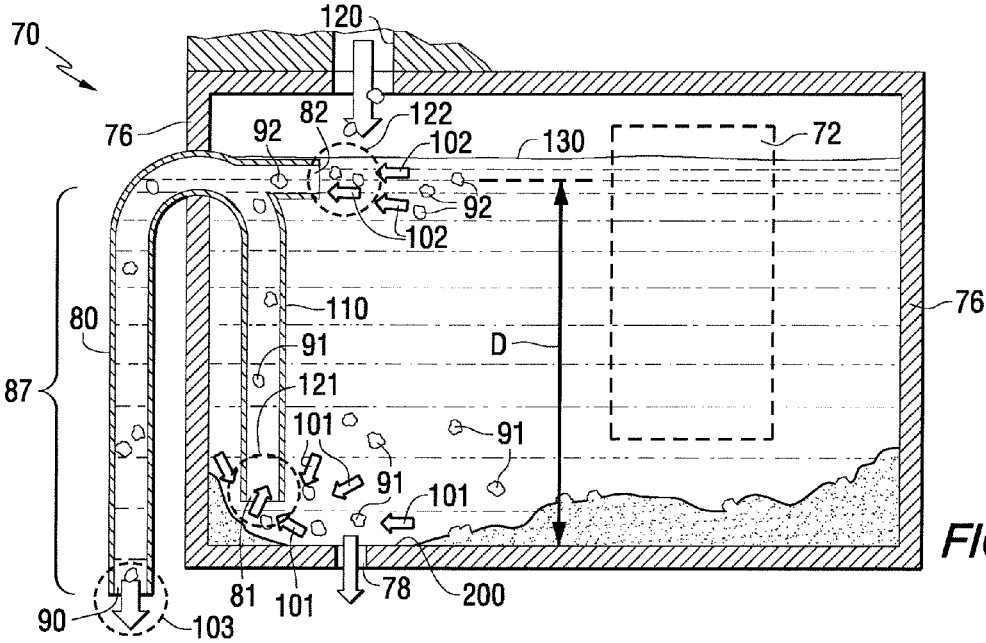
FIGS. 5 and 6 show two preferred embodiments of the present invention in highly schematic representations.
Figure 6:
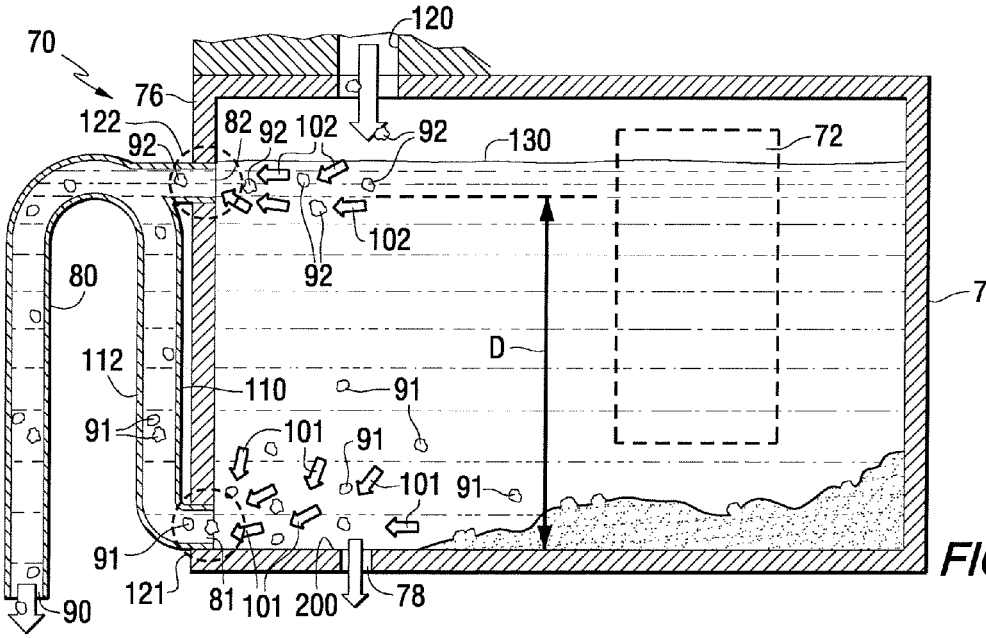

FIGS. 5 and 6 show two preferred embodiments of the present invention that can be used to achieve certain specified results that are significantly beneficial and which avoid the blockage of the drain opening 40 at the bottom of the container 10. In both of the embodiments, illustrated in FIGS. 5 and 6, an important function is to sweep debris away from the drain opening at the bottom of the container and to prevent the accumulation of debris at the surface of the water that is temporarily accumulated within the container. In FIGS. 1-4, the drain opening 40 is shown extending through the bottom portion of the container 10 and, more particularly, through the bottom surface of the first cavity 21 of the container 10. In addition, the drain opening 40 described above is susceptible to being blocked by debris. In the description below, in conjunction with FIGS. 5, 6, and 9-11, the drain opening 78 is not susceptible to being blocked by debris, at least not to the same degree as drain opening 40. Therefore, throughout the descriptions of the water distribution systems above and below, the use of reference numerals 40 and 78 also designate the relationship of the drain opening to other components and the degree to which those other components are configured and positioned to inhibit debris from blocking the drain opening. One other notable difference between the embodiments shown in FIGS. 5 and 6 is the position of the conduit relative to the container as will be more specifically described below. In FIGS. 5 and 6, the water flow is identified by reference numerals, whereas with respect to other Figures these water flows are discussed in the text and sometimes represented by arrows without reference numerals. This has been done to avoid confusion that could be caused by clutter due to too many numerals and arrows in confined spaces. Those skilled in the art can understand the various water flows by comparing the location and direction of the arrows in the various Figures, with or without the reference numerals.

With continued reference to FIGS. 5 and 6, an outboard motor cooling water distribution system made in accordance with the preferred embodiments of the present invention comprises an internal combustion engine 12 as was described above in conjunction with FIG. 1 and as will be described below in conjunction with FIG. 5. In addition, it comprises a vertical crankshaft supported by the internal combustion engine for rotation about a generally vertical axis. The preferred embodiments comprise a water circulation system 70 that is disposed in thermal communication with a heat emitting component 72, such as an oil sump or an exhaust pipe, of the internal combustion engine. The water circulation system 70 is configured to receive water from a body of water in a manner which will be described below in conjunction with FIG. 7. The preferred embodiments further comprise a container 76 which is configured to receive water from the water circulation system. It should be understood that the water circulation system comprises a water jacket 14 of the engine 12 as described above in conjunction with FIG. 1. As described above, the preferred embodiments further comprise the drain opening 78 that is formed through a bottom portion of the container 76 and configured to allow a portion of the water to slowly flow out of the container 76. The preferred embodiments of the present invention further comprise a conduit 80 having a first inlet opening 81, an outlet opening 90, and a second inlet opening 82. The first inlet opening 81 is spaced apart from the drain opening 78 and disposed at a first location 121 which induces a first water flow 101 which causes a first group of debris 91 to move relative to the drain opening 78 and become entrained within the first water flow 101. The conduit 80 is configured to direct a majority of the first water flow 101 and at least some of the first group of debris 91 through the outlet opening 90 and away from the container 76. The second inlet opening 82 of the conduit 80 is disposed at a second location 122 which induces a second water flow 102 which causes a second group of debris 92 to become entrained within the second water flow 102. The outlet opening 90 is disposed at a third location 103.

With continued reference to FIGS. 5 and 6, the conduit 80 is configured to direct a majority of the second water flow 102 and at least some of the second group of debris 92 through the outlet opening 90 and away from the container 76. In a preferred embodiment of the present invention, the heat emitting component 72 is an oil sump which is disposed in fluid communication with oil conduits of an oil circulating system 30 of the internal combustion engine 12 as described above in conjunction with FIG. 1. The oil sump is disposed in thermal communication with the water within the container 76, in FIGS. 5 and 6, as described above in conjunction with the container 10 illustrated in FIG. 1.

The preferred embodiment of the present invention shown in FIG. 5 disposes a portion 110 of the conduit 80 between the first and second inlet openings, 81 and 82, within the container 76. In comparison, the portion 112 of the conduit 80 between the first and second inlet openings, 81 and 82, illustrated in FIG. 6 is disposed outside the container 76. This difference between the location of the portions, 110 and 112, distinguishes two preferred embodiments of the present invention from each other, but it should be understood that both embodiments are considered to be within the scope of the present invention.

With continued reference to FIGS. 5 and 6, the conduit 80 is configured to direct all of the first and second water flows, 101 and 102, through the outlet opening 90 in the preferred embodiments shown in FIGS. 5 and 6, but that characteristic is not required in all other embodiments of the present invention. In addition, the preferred embodiments of the present invention illustrated in FIGS. 5 and 6 are intended to be used in conjunction with a water system in which a majority of the first group of debris 91 is denser than the water and is also denser than the second group of debris 92.

With continued reference to FIGS. 5 and 6, the second inlet 82 is configured to determine a depth of the water within the container 76 as a function of the position of the second inlet opening 82 relative to the bottom surface of the container. That depth is represented by reference letter D in FIGS. 5 and 6.

Preferred embodiments of the present invention further comprise a cooling water input conduit which was identified in FIG. 1 by reference numeral 36 and which is identified in FIG. 5 by reference numeral 120. In the embodiment of the present invention illustrated in FIG. 5, this cooling water input conduit 120 is intended to represent a conduit which connects the container 76 to a structure of the outboard motor, such as an adapter plate that supports the internal combustion engine 12 that is described above in conjunction with FIG. 1. Various alternative conduits can be used to direct cooling water from the water jacket of the engine to the internal cavity of the container 76 which is located below the internal combustion engine and within the structure of the driveshaft housing of the outboard motor. This overall configuration allows the heat emitting component 72 to be disposed in thermal communication with the water within the internal cavity of the container 76 which is normally disposed in a location that allows the oil sump to be conveniently located.

Although certain embodiments of the present invention can include a container 76 that is not sealed from the environment, preferred embodiments of the present invention comprise a container in which all fluid communication with the container 76 is limited to the communication through the first and second inlet openings, 81 and 82, the water circulation system (through conduit 120), and the drain opening 78. It should be understood that fluid communication through the first and second inlet openings, 81 and 82, include the outlet 90 which is connected to them through the conduit 80.

With continued reference to FIGS. 5 and 6, it should be understood that an important function of the preferred embodiments of the present invention is the maintenance of the region surrounding the drain opening 78 in a clear condition to prevent the buildup of the first group of debris 91 in that region. By causing the first water flow 101 to move past the drain opening 78 with a relatively significant velocity, the first group of debris 91 is entrained within the first water flow 101 and carried toward and into the first inlet opening 81. The first location is identified by a dashed line circle and by reference numeral 121. The specific position of the first location 121 is not one which is mathematically calculated. Instead, it is empirically determined as a function of the surrounding structure and the contour of the surrounding surfaces. Since the internal shape of the cavity within the container 76 will be expected to vary as a function of other requirements of the outboard motor, its internal configurations and surface contours will also vary. As a result, the position and shape of the first inlet opening 81 can be expected to be determined empirically and, in some cases, through trial and error. However, it is important to also realize that this empirical determination is important because it results in a first water flow 101 that is sufficient to entrain the first group of debris 91. It is expected that at the first water flow 101 not only will entrain particles of the first group of debris 91 that are still suspended in the water within the container 76, but also remove particles of the first group of debris 91 that have already settled near the bottom of the container 76. If properly located, the first inlet opening 81 will induce a sufficient first water flow 101 that can remove particles of a first group of debris 91 from attachment to the lower surfaces of the internal cavity of the container 76. Similarly, the location and shape of the second inlet opening 82 will induce the entrainment of a second group of debris 92 that is suspended in the water near its surface 130. The second water flow 102 will entrain the second group of debris 92 and direct its movement into the second inlet opening 82 and into the conduit 80. In the embodiments shown in FIGS. 5 and 6, the first and second inlet openings, 81 and 82, are configured to direct their entire flow through the conduit 80 and out of the outlet opening 90. In some embodiments of the present invention, there may be reason that makes it desirable to direct part of this flow elsewhere. It should be understood that this election to direct part of the flow through an additional opening of the conduit 80 is not limiting to the present invention. The location of the second inlet opening 82, which is identified by reference numeral 122 and a dashed line, not only entrains the second group of debris 92, but also determines the height D of the water within the container 76. In addition, it performs another function which may not be readily apparent. When the outboard motor is turned off after a period of operation, the conduit 80 would otherwise cause the majority of the water within the cavity inside the container 76 to flow out of the container if the second inlet opening 82 was not present. This would occur because of the siphon action of the conduit 80 which, if the second inlet opening 82 was not present, would cause the water inside the container 76 to flow out of the container until the water level D reached the height of the first inlet opening 81. This drains virtually all of the water from the container 76 and significantly affects the cooling function of the water within the container that reduces the temperature of the heat emitting component 72. Instead, because of the presence of the second inlet opening 82, the water will drain slowly out of the container 76 through the drain opening 78, but this rate of flow will be much slower than would otherwise be the case if the siphon effects of the conduit 80 were allowed to occur without the presence of the second inlet opening 82.

With continued reference to FIGS. 5 and 6, the first group of debris 91 typically comprises soil, silt, and sand which is suspended within the water of the body of water in which the outboard motor is operated. When operated in saltwater, an additional problem can be encountered. A blocked drain opening 78 which causes the water to remain for an extended period of time within the cavity of the container 76 can give the saltwater an opportunity to allow the salt to adhere to the internal surfaces of the container 76 and, eventually, harden and create an attachment which is difficult to remove. That attachment surface can eventually block conduits though which the water is intended to flow out of the outboard motor.

The second group of debris 92 is typically expected to comprise floating materials that had been previously discarded into the body of the water and also vegetation which is less dense than the water in which it is suspended. If the second inlet opening 82 is not provided, those particles would remain suspended during the entire operation of the outboard motor and may not be drawn through the first inlet opening 81 during the infrequent periods when the outboard motor is turned off. It should be understood that the provision of the second inlet opening 82, which allows the less dense materials to be drawn into the conduit 80 and out through the outlet 90 during normal operation of the outboard motor while it is running is highly preferable to the alternative and much more likely to maintain the internal cavity of the container 76 free of that type of debris which is lighter than water. In conclusion, the first and second locations, 121 and 122, of the first and second inlet openings, 81 and 82, are meant as a general location where these openings can be expected to perform the functions described above in a satisfactory manner. Naturally, alternative positions can perform these functions although in a slightly different manner which could be more or less preferable, depending on the internal surface configurations inherent in the design of the water distribution system. It can be seen, however, that significant advantages can be achieved through the proper positioning of the inlet openings. The removal of current moving debris near the first and second locations, 121 and 122, and previously deposited debris can be removed from the container 76.

Figure 7:
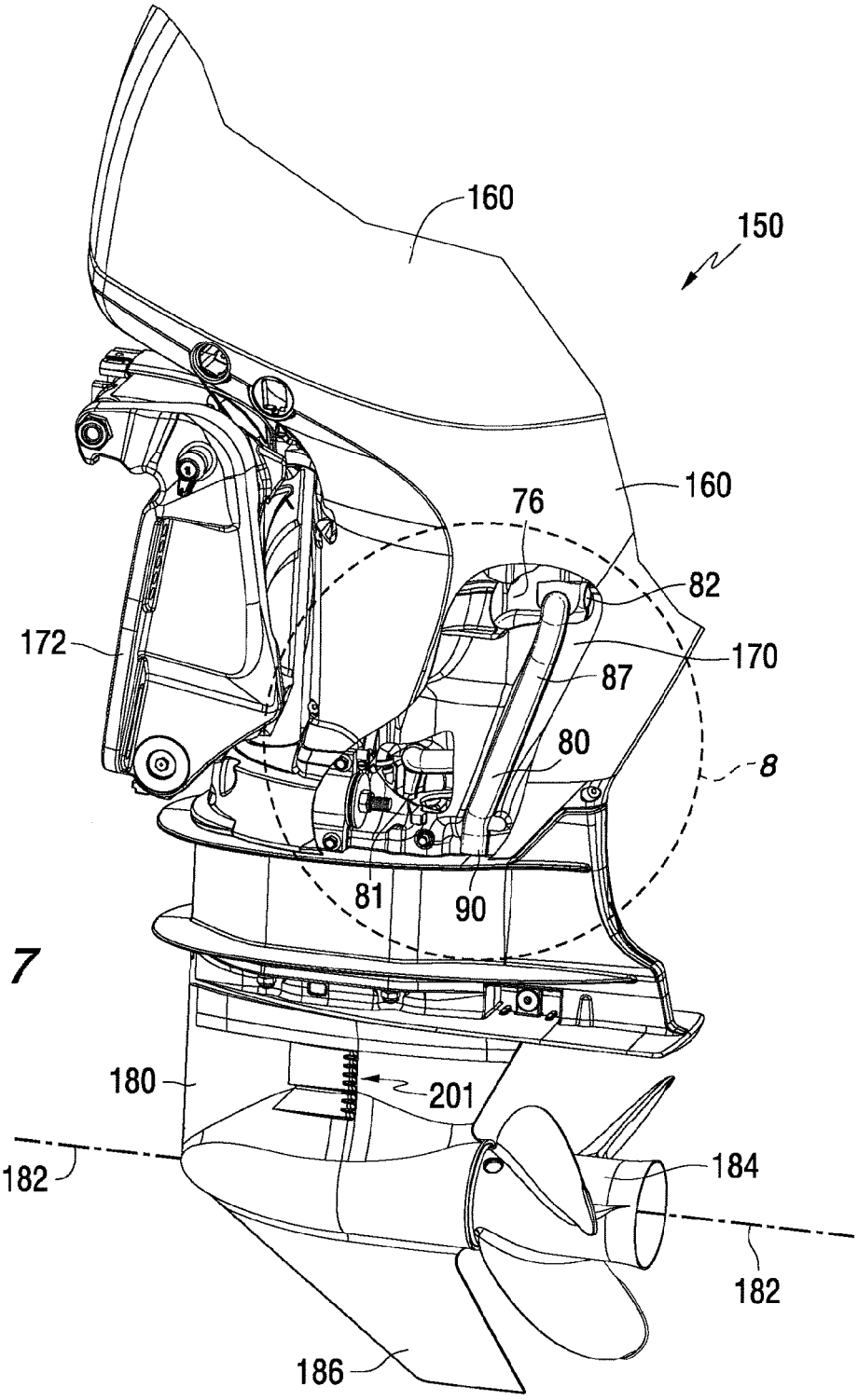
FIG. 7 illustrates an isometric view of an outboard motor with a portion of the outboard motor removed from the illustration for the purposes of simplicity.

FIG. 7 is an isometric view of an outboard motor 150 with portions of its cowl 160 and its driveshaft housing 170 cut away. Most of the portions of the outboard motor 150 illustrated in FIG. 7 are not directly related to the preferred embodiments of the present invention and therefore will not be described in detail herein. As is generally well known by those skilled in the art of marine propulsion systems, outboard motors such as the one illustrated in FIG. 7 are attached to a transom of a marine vessel through the use of a transom bracket 172. Below the driveshaft housing 170 is a gear case 180 within which a propeller shaft is supported for rotation about a generally horizontal axis 182. Within the driveshaft housing 170, a driveshaft is supported for rotation about a generally vertical axis that is perpendicular to the propeller shaft axis 182 and which is connected in torque transmitting relation with the propeller shaft by gears located within the gear case 180. A propeller 184 can be attached to the propeller shaft. At the bottom of the structure, a skeg 186 is attached. Within the dashed line circle in FIG. 7 a cutaway portion of the driveshaft housing 170 exposes an internal region of the internal cavity within the container 76 which illustrates a portion 87 of the conduit 80 that is described above in conjunction with FIG. 5. Although the elements illustrated within the dashed circle 8 in FIG. 7 will be described in greater detail below in conjunction with FIG. 8, the view in FIG. 7 shows the first inlet opening 81 and second inlet opening 82 along with the portion 87 of the conduit 80 to provide a positional perspective of these components.

Those skilled in the art of marine propulsion devices are familiar with the fact that in a typical outboard motor 150, an internal combustion engine is supported under the cowl 160 and connected to a driveshaft which extends downwardly from a crankshaft of the engine. The engine is typically supported on an adapter plate through which oil is conducted to and from the oil sump (such as the one functionally described above) and cooling water is directed upwardly by a water pump that draws water through various openings 201 and upwardly to cooling channels within a water jacket of the engine. After flowing through the engine, as described above in conjunction with FIG. 1, the water is directed downwardly into the container, wherein it is used to cool certain components such as the oil sump 72 as described above in conjunction with FIGS. 5 and 6.

Figure 8:
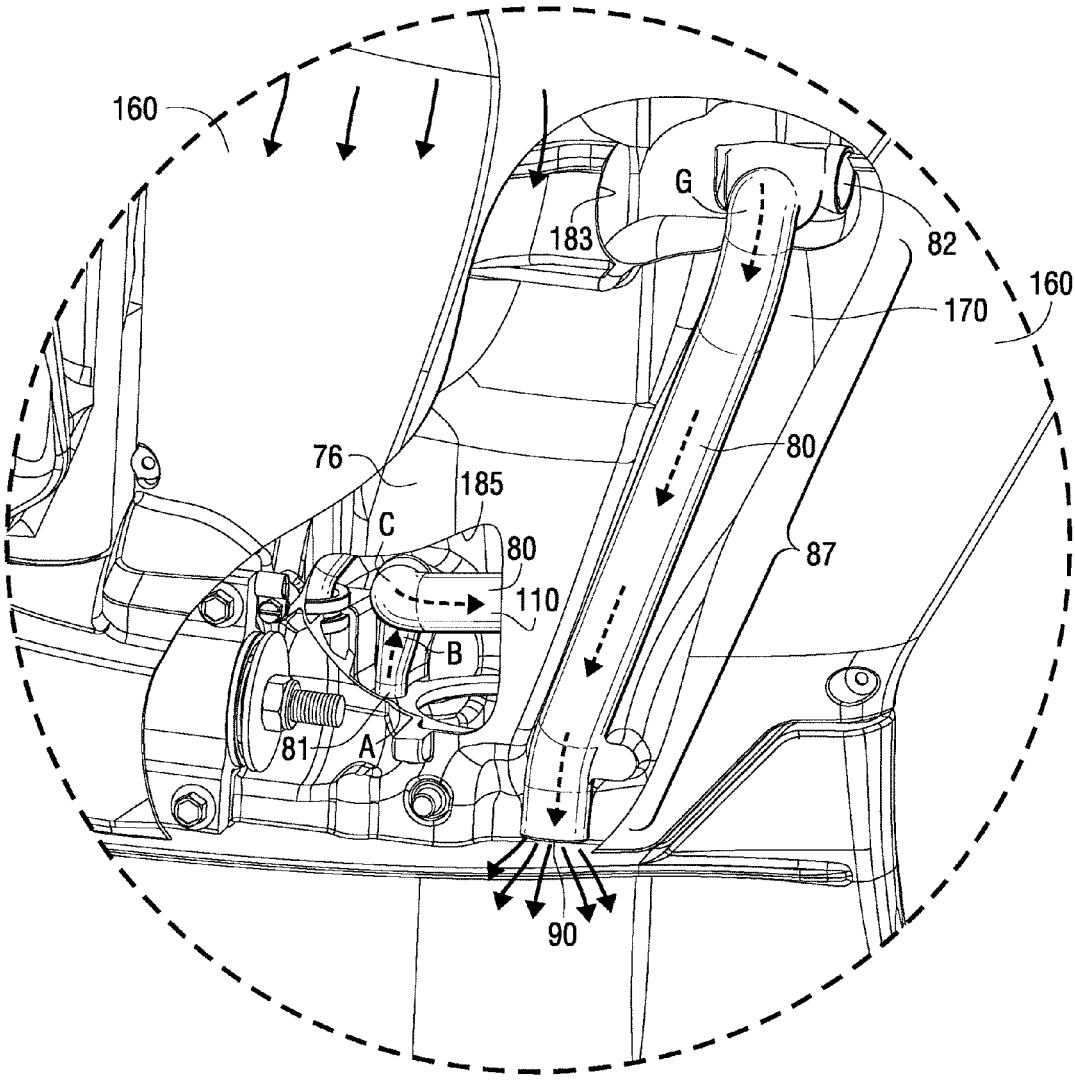
FIG. 8 is a partial view of a portion of the outboard motor shown in FIG. 7.

FIG. 8 shows the cutaway portion formed through the driveshaft housing 170 which illustrates, inter alia, the portion 87 of the conduit 80 which lies outside of the cavity of container 76. The end of the conduit 80 which is identified by letter A in FIG. 8 is most proximate to the first inlet opening 81 described above in FIG. 5. The alphabetic characters associated with portions of the conduit 80 in FIG. 8 are intended to consecutively describe the direction of travel of water after it enters the first inlet opening 81 and proceeds through the conduit 80 to its outlet opening 90. It should be understood, however, that not all letters are used in each illustration and, in addition, some portions of the conduit are not visible in some of the illustrations. The cutaway identified by reference numeral 183 in FIG. 8 is intended to identify a wall between the inside of container 76 and the outside of container 76 and reference numeral 170 is intended to identify a wall of the driveshaft housing. Similarly, the cutaway identified by reference numeral 185 separates the inside cavity of the container 76 from the region between the container wall and the driveshaft housing 170. As the water rises through the conduit 80, from the region identified by reference letter A and identified as the first inlet opening 81, the water rises through the portion 110 of the conduit inside the container until it reaches an uppermost portion of the conduit 80, near the second inlet opening 82, and turns downwardly (see dashed line arrows) to pass through portion 87 of conduit 80 in the portion of the conduit which lies between the outer wall of container 76 and the inner surface of the cowl 160. Through this portion, the water is directed downwardly and eventually discharged back to the body of water in which the outboard motor is operating.

Figure 9:
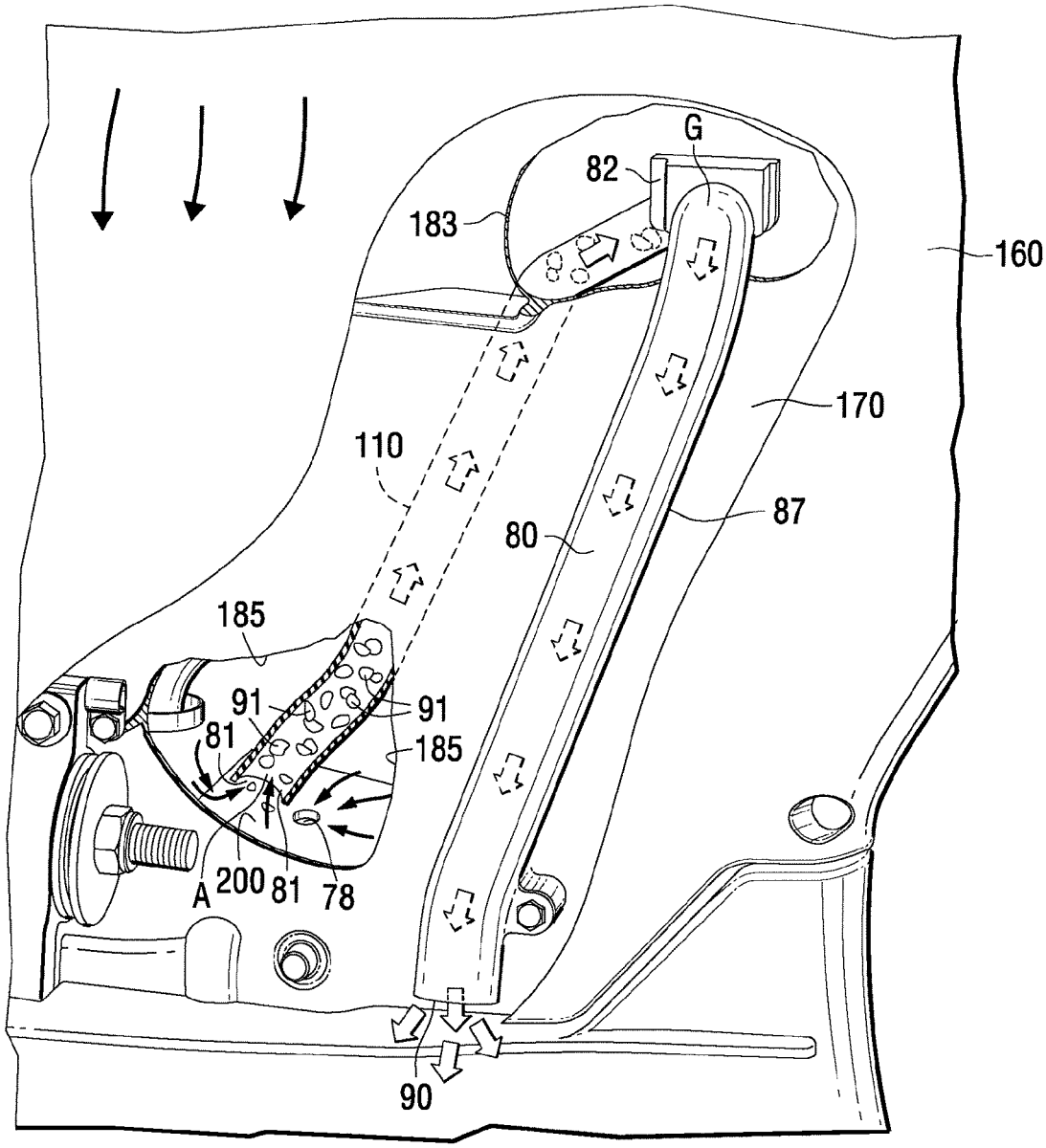
FIG. 9 is a simplified version of the illustration of FIG. 8.

With reference to FIG. 9, which is a simplified version of FIG. 8, and to FIGS. 5 and 6 with respect to water flows, the proper operation of the preferred embodiments of the present invention depends to a significant degree on the relative positions of the drain opening 78 and the first inlet opening 81. As described above, these relative positions can be determined empirically during the design of the system and an appropriate shape of the overall conduit 80 can be configured so that the first inlet opening 81 can be appropriately located at a vertical distance from the bottom surface 200 and a proper horizontal distance away from the drain opening 81 so that the first water flow 101 is directed at the proper velocity and in the proper directions to induce the first group of debris 91 to become entrained and to be drawn into the first inlet opening 81 of conduit 80. This first group of debris 91 is illustrated hypothetically in the bottom portion of the conduit 80 near the first inlet opening 81 in FIG. 9. If the position and configuration of the first inlet opening 81 is properly selected, the first group of debris 91 in the region of the drain opening 78 will be removed and the drain opening will remain clear. This condition is schematically represented in FIGS. 5 and 6 and the absence of the first group of debris 91 on the bottom surface 200 is also illustrated in FIG. 9. Although it is difficult to illustrate these important concepts, it can be seen in the figures and in the description above that the region surrounding the drain opening 78 can be kept relatively clean by the appropriate positioning of the first inlet 81. This appropriate configuration, which causes the first water flow 101 to have an appropriate velocity and direction in the region of the drain opening 78, is one of the key characteristics of the preferred embodiments of the present invention and, even though it is difficult to specify the precise position of the first inlet opening 81 in objective and quantifiable terms, it can be easily understood that at least one position of the first inlet opening relative to the drain opening 78 will result in a first water flow 101 that is sufficient to maximize the entrainment of the first group of debris 91 within that stream of water. It should also be understood that in certain shapes of containers 76, several alternative positions and configurations of the first inlet opening 81 will suffice to maintain a clean surface surrounding the drain opening 78 which are relatively free of debris.

With continued reference to FIGS. 8 and 9, it should be understood that both of these figures illustrate the same general region of the outboard motor and, more particularly, of the cutaway portion of the driveshaft housing 170 and the container 76 shown in FIG. 7. It should also be understood that, due to the complex shape of the conduit 80, it is very difficult to show all of the portions of the conduit 80 in a single illustration. However, the concepts of the preferred embodiments of the present invention can also be incorporated into alternative embodiments that do not use a conduit 80 which is as complex in shape as the conduit illustrated in FIGS. 8 and 9. FIGS. 5 and 6, as described above, show the preferred embodiments of the present invention in a more simplified schematic illustration for the purpose of illustrating these concepts in conjunction with a more simple shape of conduit 80 which does not have the complex bends of the actual implementation that is depicted in FIGS. 8-11.

Figure 10:
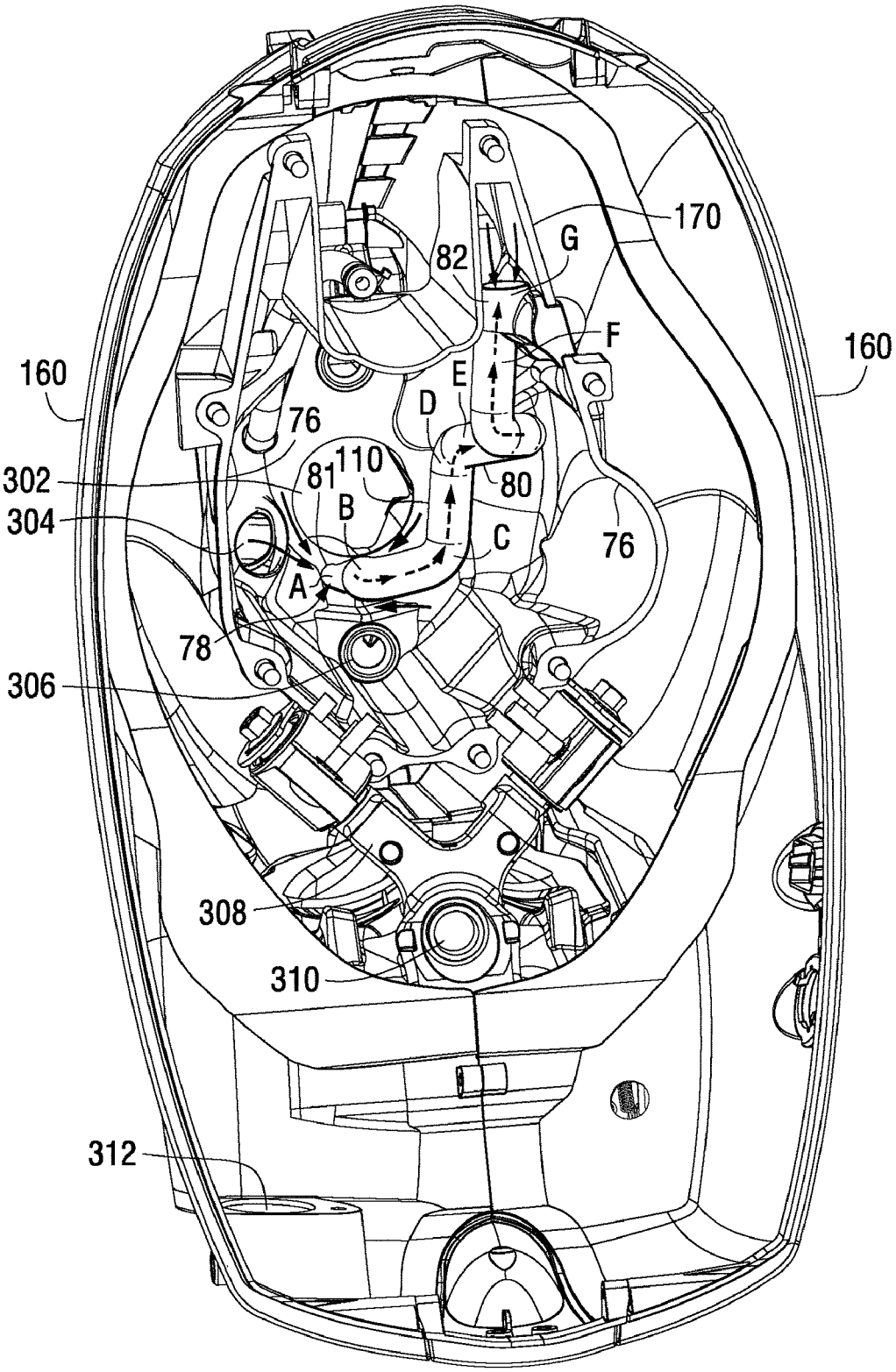
FIG. 10 is a top section view of the outboard motor in FIG. 7 with portions of wall surfaces removed to enhance visibility of certain components.
Figure 11:
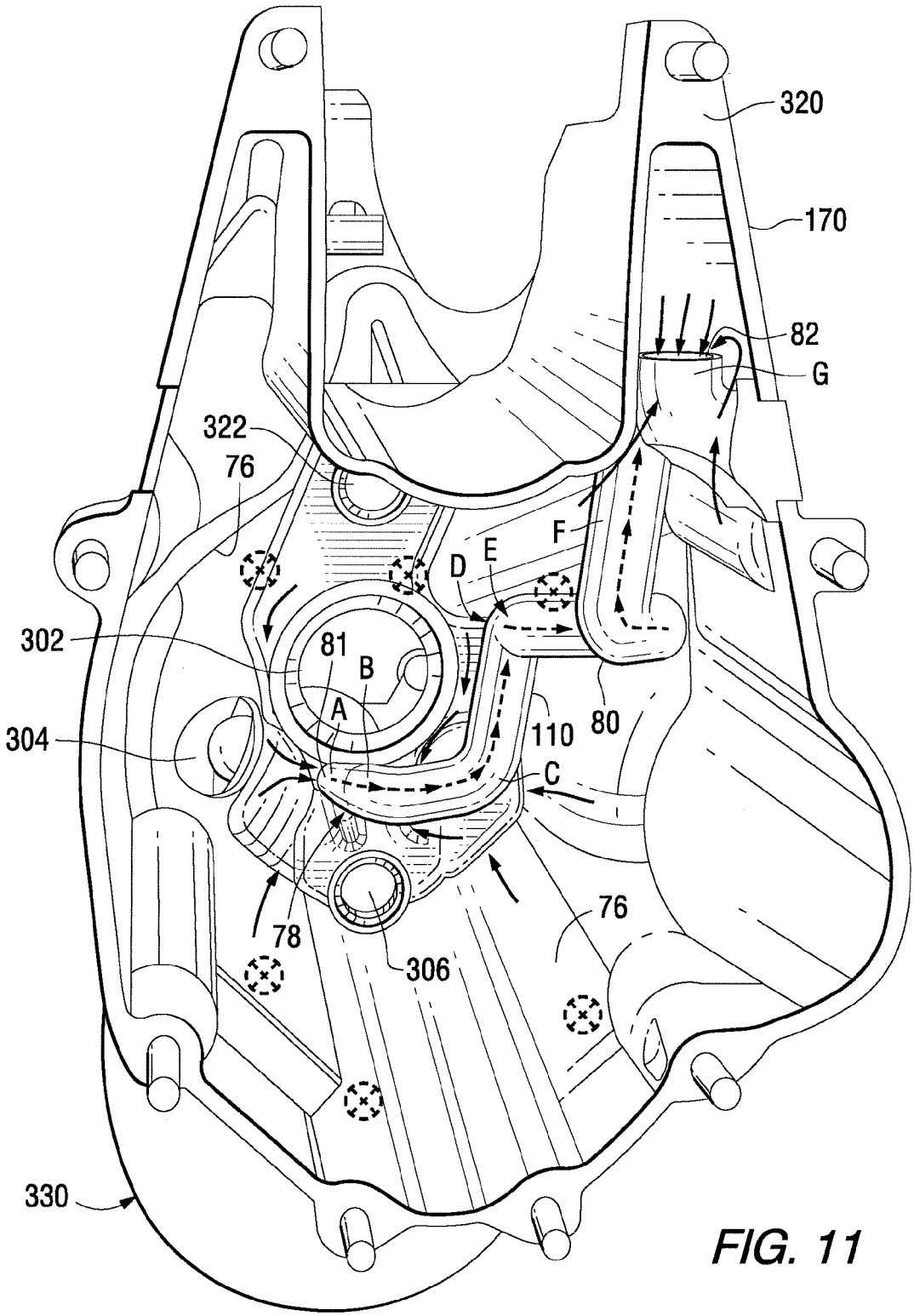
FIG. 11 is a simplified version of the illustration shown in FIG. 10.

FIGS. 10 and 11 illustrate one embodiment of the present invention in views taken from above the structure and in section views taken through the driveshaft housing of the outboard motor illustrated in FIG. 7. FIG. 10 and FIG. 11 both show the same general area of the outboard motor, but FIG. 11 is more simplified because numerous components are removed from the illustration in order to more properly show the position and shape of the conduit 80.

In FIG. 10, the driveshaft housing 170 surrounds the structure which includes the container 76. Although the shape of the container 76 is complex and difficult to illustrate in a single picture, the conduit 80 is illustrated in FIG. 10 in a way which shows the first inlet opening 81 proximate to the drain opening 78 which is adjacent to it, but not easily visible. The drain opening 78, however, can be more easily seen in FIG. 11 where it is located in a depression formed in an internal surface of the container 76. The container 76 is illustrated in FIG. 11 without the cowling 160 that is illustrated in FIG. 10.

With reference to FIGS. 5 and 10, the portion 110 of the conduit 80 is clearly visible between the first inlet opening 81 and the second inlet opening 82, with arrows indicating the direction of water flow both within the conduit (with dashed line arrows) and outside the conduit (with solid line arrows). The same is true in FIG. 11 which shows the water flow within the conduit 80 and which also shows the portion 110 of the conduit located between the first inlet opening 81 and the second inlet opening 82.

With reference to FIGS. 1-11, those skilled in the art of marine propulsion systems understand that outboard motors typically have cooling systems that are designed to conduct water through the driveshaft housing prior to being directed back to the body of water from which it was originally drawn. Depending on the specific requirements for cooling various components within the driveshaft housing (e.g. exhaust conduits and oil sumps), a water dam of some type can be used to maintain a desired water level within the driveshaft housing to surround these components with water. Often, a separate container is provided within the driveshaft housing for this purpose. The provision of a water dam and internal cavities is described above in conjunction with FIGS. 1-4 along with a discussion of some of the problems associated with this type of cooling system design. Those problems are related to the effects that can be caused by debris within the cooling water. A first group of debris is denser than water and settles in the area near a drain opening while a second group of debris is less than dense than water and floats near the surface of the water within the container. The need for the drain opening is also described above in conjunction with FIGS. 1-4. In conjunction with FIGS. 5 and 6, two embodiments of the present invention are described above in which the water flow into a conduit is advantageously used to sweep the area around the drain opening clean of the first group of debris. A second inlet opening is provided in the conduit to remove floating debris from the surface of the water within the container. Both of the inlet openings are configured to direct their respective water flows into and through the conduit and out of its outlet opening so that these water flows can be returned to the body of water from which the water was originally drawn. FIGS. 5 and 6 were intentionally drawn in a highly schematic manner in order to describe the basic concepts of the preferred embodiments of the present invention while avoiding the complexity that invariably makes the description more difficult. Although the advantageous characteristics of the embodiments of the present invention are fully and completely described in conjunction with FIGS. 5 and 6, after describing the problems in conjunction with FIGS. 1-4, specific applications of one embodiment of the present invention are described in conjunction with a particular outboard motor design which is illustrated in FIG. 7 with various section and cutaway views shown in FIGS. 8-11. It should be understood that FIGS. 7-11 are related specifically with the preferred embodiment of the present invention that is described more simply in FIG. 5. The alternative embodiment of the present invention shown schematically in FIG. 6 is not embodied in the actual implementation illustrated in FIGS. 7-11, but it should be understood that that actual implementation could be modified to employ an application of the present invention in which the conduit 80 is located outside of the container 76 and inside of the driveshaft housing 170.

Regardless of the specific way in which the concepts of the present invention are employed in an outboard motor, its basic goals can be simply described, in conjunction with FIGS. 1-11, as the management of water flow from a cooling system 14 of an engine 12 through the structure of an outboard motor and the use of that water flow to cool various components of the outboard motor, such as its exhaust conduit and oil sump 24. The water management system then returns the water back to the body of water in which the outboard motor 150 operated. Although it is not directly related to the basic concepts of the preferred embodiments of the present invention, the water is drawn through openings of the outboard motor 150 and then returned to the body of water through various paths after its functions have been completed. In summary, the outboard motor 150 has a cooling water distribution system, according to various embodiments of the present invention, which comprise an internal combustion engine 12, a vertical crankshaft supported by the internal combustion engine for rotation about a generally vertical axis, a water circulation system which is disposed in thermal communication with a heat emitting component 24 of the internal combustion engine, such as an oil sump, in which the water circulation system is configured to receive water from a body of water in which the outboard motor cooling water distribution system is operating. It further comprises a container 76 which receives the water from the water circulation system that typically comprises a water jacket 14 of the engine. A drain opening 78 is formed through a bottom surface 200 of the container 76 and configured to conduct a portion of the water out of the container 76. A conduit 80 is provided and has a first inlet opening 81, a second inlet opening 82, and an outlet opening 90. The first inlet opening 81 is spaced apart from the drain opening 78 and disposed at a first location 121 which induces a first water flow 101 which causes a first group of debris 91 to move relative to the drain opening 78 and become entrained within the first water flow 101. It should be understood that the first location 121 can comprise several alternative and potential locations which could serve the purpose of inducing the first water flow 101 to entrain the first group of debris 91 and enter the first inlet opening 81 of the conduit 80. The conduit 80 is configured to direct a majority of the first water flow 101, and potentially all of the water flow, and at least some of the first group of debris 91 through the outlet opening 90 and away from the container 76. The second inlet opening 82 is disposed at a second location 122 which induces a second water flow 102 that causes a second group of debris 92 to become entrained within the second water flow 102. The outlet opening 90 is disposed at a third location 103 which is selected to direct the second water flow 102 away from the container 76. The conduit 80 is configured to direct a majority of the second water flow 102 and at least some of the second group of debris 92 though the outlet opening 90 and away from the container 76. It should be understood that in certain preferred embodiments of the present invention, all of the first and second water flows, 101 and 102, and all of the first and second groups of debris, 91 and 92, are directed through the conduit 80 and through the outlet opening 90 and away from the container 76. However, some embodiments of the present invention can be configured in such a way that portions of the water flows and some of the debris can be directed through alternate openings and toward alternate destinations.

With continued reference to FIGS. 1-11, the heat emitting component 24 of the internal combustion engine 12 is an oil sump which is disposed in fluid communication with oil conduits 30 of the internal combustion engine and is disposed in thermal communication with the water within the container 76. With particular reference to FIGS. 5 and 6, a portion of the conduit 110, between the first and second inlet openings, 81 and 82, can be disposed within the container 76. Alternatively, a portion 112 of the conduit 80 which is located between the first and second inlet openings, 81 and 82, can be located outside of the container 76 as illustrated in FIG. 6. In certain embodiments of the present invention, the conduit 80 can be configured to direct all of the first and second water flows, 101 and 102, through the outlet opening 90. In most preferred embodiments of the present invention, a majority of the first group of debris 91 is denser than the water in the container 76 and also denser than the second group of debris 92. In certain preferred embodiments of the present invention, the second inlet opening 82 is configured to determine a depth D of the water within the container 76 as a function of a position of the second inlet opening 82 relative to the bottom surface 200 of the container 76. In certain embodiments of the present invention, it can further comprise a cooling water input conduit of the water circulation system that is connected in fluid communication between the container 76 and the engine 12 to direct cooling water from a water jacket 14 of the engine 12 to an internal cavity of the container 76. The heat emitting component 24 is disposed in thermal communication with the water within the internal cavity. In certain embodiments of the present invention, all fluid communication with the container 76 is through the first and second inlet openings, 81 and 82, the water circulation system 14, and the drain opening 78, with all of the water which enters the first and second inlet openings being directed through the outlet 90 of the conduit 80.

With reference to FIGS. 7-11, the preferred embodiment of the present invention is illustrated in association with various other components that are not specifically related to the preferred embodiment, but which show a typical environment in which the present invention can be employed. For example, the driveshaft housing 170 and cowl 160 show the components that provide various walls and surfaces that define the spaces in which the conduit 80 and other components of the present invention are disposed. In FIG. 8, for example, the conduit 80 is shown directed downwardly within the space defined by the driveshaft housing 170 and, in the upper portion of FIG. 8, the downwardly directed arrows show the general locations where water flows from the top portion of the figure and downwardly in the forward two-thirds of the container. FIG. 9, which is a simplified version of FIG. 8, also shows these relationships and the arrows in the upper portion of the figure illustrate the approximate locations where water drains downwardly through the adapter plate and from the cooling conduits of the engine. FIG. 9 also illustrates the edge of a cutaway 183 near the upper portion of the illustration. As described above, this cutaway separates the inside cavity of container 76 from the region between the container wall and the driveshaft housing 170. Within that cutaway in FIG. 9, the second inlet opening 82 is shown.

In FIG. 10, an opening 302 allows an exhaust pipe to pass through a generally horizontal surface in the vicinity of a sump drain access hole 304. In addition, a water tube is provided with a pass through opening 306. In the bottom portion of FIG. 10, a swivel head 308 and a steering axis tube 310 are illustrated. In order to further describe the basic environment in which the preferred embodiments of the present invention can be employed, the structure also shows a control cable entry 312.

With reference to FIG. 11, the power head adapter flange 320 is illustrated in the upper portion of the figure. An opening 322 allows an idle relief exhaust tube to pass through a generally horizontal surface of the structure and another hole 302 is provided to permit the exhaust pipe to pass through that same horizontal surface. An oil sump drain access hole 304 and a cooling water opening 306 are both shown in the region of the first inlet opening 81 and the drain opening 78. Six positions are represented in FIG. 11 by dashed line circles which enclose a dashed line reference letter X. These dashed line circles are intended to show the positions where water drains downwardly into the container surrounding the first inlet opening 81 of the conduit 80. To further define the position of the power head adapter flange 320, a water spray plate 330 is shown at the bottom portion of FIG. 11. It should be understood that the components and openings identified in FIGS. 7-11 with reference numerals greater than 300 are intended to facilitate the understanding of the environment in which the components of the present invention are located. As such, these portions of the outboard motor are not specifically intended to describe the preferred embodiments of the present invention but, instead, are illustrated to show the various devices and surfaces, including holes, within a typical environment in which they could be located.

Although the present invention has been described with particular specificity and illustrated to show several preferred embodiments, it should be understood that alternative embodiments are also within its scope.

We claim:

1. An outboard motor cooling water distribution system, comprising:

an internal combustion engine;

a vertical crankshaft supported by said internal combustion engine for rotation about a generally vertical axis;

a water circulation system disposed in thermal communication with an oil sump disposed in fluid communication with oil conduits of said internal combustion engine, said water circulation system being configured to receive water from a body of water in which said outboard motor cooling water distribution system is operating;

a container configured to receive water from said water circulation system;

a drain opening formed through a bottom surface of said container and configured to conduct a portion of said water out of said container; and a conduit having a first inlet opening, a second inlet opening, and an outlet opening, said first inlet opening being spaced apart from said drain opening and disposed at a first location which induces a first water flow which causes a first group of debris to move relative to said drain opening and become entrained within said first water flow, said second inlet opening disposed at a second location which induces a second water flow which causes a second group of debris to become entrained within said second water flow, said outlet opening being disposed at a third location, said conduit being configured to direct a majority of said first water flow, a majority of said second water flow, at least some of said first group of debris, and at least some of said second group of debris through said outlet opening and away from said container.

2. The system of claim 1, wherein:

a portion of said conduit, between said first and second inlet openings, is disposed within said container.

3. The system of claim 1, wherein:

said conduit is configured to direct all of said first and second water flows through said outlet opening.

4. The system of claim 1, wherein:

a majority of said first group of debris is denser than said water and denser than said second group of debris.

5. The system of claim 1, wherein:

said second inlet opening is configured to determine a depth of said water within said container as a function of a position of said second inlet opening relative to said bottom surface of said container.

6. The system of claim 1, further comprising:

a cooling water input conduit of said water circulation system connected in fluid communication between said container and said engine to direct cooling water from a water jacket of said engine to an internal cavity of said container, said oil sump being disposed in thermal communication with said water within said internal cavity.

7. The system of claim 1, wherein:

all fluid communication with said container is through said first and second inlet openings, said water circulation system, and said drain opening.

* * * * *